US010315297B2

(12) United States Patent
Hu

(10) Patent No.: US 10,315,297 B2
(45) Date of Patent: Jun. 11, 2019

(54) TORQUE INDICATION WRENCH

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 274 days.

(21) Appl. No.: 15/585,636

(22) Filed: May 3, 2017

(65) Prior Publication Data

US 2018/0236642 A1 Aug. 23, 2018

(30) Foreign Application Priority Data

Feb. 20, 2017 (TW) ..... 106105653 A

(51) Int. Cl.
*B25B 23/142* (2006.01)

(52) U.S. Cl.
CPC ..... *B25B 23/1427* (2013.01)

(58) Field of Classification Search
CPC ..... B25B 23/1427; B25B 23/142; B25B 23/1422; B25B 23/14
See application file for complete search history.

(56) References Cited

U.S. PATENT DOCUMENTS 164,100 A * 6/1875 Plymale ..... B25B 23/1427 73/862.23
2,144,731 A * 1/1939 Zimmerman ..... B25B 23/1427 73/862.21
2,159,373 A * 5/1939 Dunn ..... B25B 13/463 73/862.26
2,167,720 A * 8/1939 Kress ..... B25B 23/1427 73/862.26
2,231,240 A * 2/1941 Zimmerman ..... B25B 23/1427 73/862.26
2,279,792 A * 4/1942 Larson ..... B25B 23/1427 73/862.26
2,312,104 A * 2/1943 Larson ..... B25B 23/1427 73/862.21
2,343,380 A * 3/1944 Larson et al. ..... B25B 13/465 73/862.21
2,715,333 A * 8/1955 Larson ..... B25B 23/1427 73/862.21
2,749,786 A * 6/1956 Ollagnon ..... B25B 23/1427 73/862.23
3,608,403 A * 9/1971 Green ..... B25B 23/1427 81/477
3,824,880 A * 7/1974 Zerver ..... B25B 23/1427 81/481

(Continued)

*Primary Examiner* — David B. Thomas
(74) *Attorney, Agent, or Firm* — WPAT, PC

(57) ABSTRACT

A torque indication wrench includes a main body having a wrenching portion and a support portion, a torque rod having a first end and a second end, and an indication device disposed between the main body and the torque rod. The wrenching portion drives an object. The first end is connected with the support portion. The main body defines a longitudinal line dividing the torque into a counterclockwise and an opposite clockwise areas. A biasing section is formed between the first and second ends, with the central axis of the biasing section positioned in the counterclockwise area. The user wrenches the second end of the torque rod, such that the biasing section of the torque rod resiliently bends from the counterclockwise area toward the clockwise area, and the user is able to read an indicated torque value.

16 Claims, 11 Drawing Sheets

(56) References Cited

U.S. PATENT DOCUMENTS 4,226,127 A * 10/1980 Hardiman ..... B25B 23/1427
73/761
7,597,032 B2 * 10/2009 Baumgartner ..... B25B 13/463
81/467

* cited by examiner

TORQUE INDICATION WRENCH

BACKGROUND OF THE INVENTION

1. Field of the Invention

The present invention relates to small sized torque wrenches, and more particularly, to a torque wrench requiring only limited operational space.

2. Description of the Related Art

Referring to FIG. 1, a conventional fine-tunable torque wrench comprises a shaft 1, an operation rod 2, a pointer 3, an operation head 4, and a scale plate 5. The shaft 1 and the operation head 4 are disposed on two ends of the operation rod 2, with the scale plate 5 fixed to the operation rod 2. The pointer 3 has one end thereof attached to the operation head 4, with the other end thereof pointing to the scale plate 5. When a force is imposed on the shaft 1, the operation rod 2 is bent due to the force while the pointer 3 keeps being straight. Therefore, the user learns the torque value by reading the scales on the scale plate 5 pointed by the pointer 3.

However, the pointer 3 may possibly cause harm upon the user. Also, the transversely disposed scale plate 5 occupies a relatively large space, failing to meet the convenience of storage.

Therefore, referring to FIG. 2, an improved torque wrench 10 is developed, which is a torque tool applicable to a bicycle. The torque wrench 10 comprises a main body 11 and a scaling device 12. The main body 11 includes a handle 13 and a driving rod 14. The handle 13 is designed to store various types of driver heads. The driving rod 14 has one end thereof disposed on the handle 13, with the other end thereof provided with a driving portion 15 for driving a screw member. The scaling device 12 includes a pointer 12*a* and a scale member 12*b*. The pointer 12*a* has one end thereof disposed on the handle 13, with the other end thereof pointing at the scale member 12*b*, while one end of the scale member 12*b* is mounted around the driving rod 14. When the user operates the torque wrench 10, the pointer 12*a* is displaced and therefore points at a corresponding scale on the scale member 12*b*, such that the torque value imposed through the driving portion 15 is acquired.

However, the pointer 12*a* on such torque wrench 10 may still cause harm to the user. Also, such torque wrench 10 is generally formed in a T shape. Hence, the torque wrench 10 consumes a relatively large space, failing to meet the convenience or portability and storage.

Another improved torque wrench 20 is further developed, as shown by FIG. 3 and FIG. 4. The torque wrench 20 comprises a housing 21, a driving rod 22, and a pointing member 23. The housing 21 comprises an upper housing 21*a* and a lower housing 21*b*, and is applied for storing multiple tool heads 24. The driving rod 22 has one end thereof fixed to the housing. An indication window 25 opens on the upper housing 21*a*, with multiple values 25*a* marked round the indication window 25. The pointing member 23 is disposed on the housing 21 with one end thereof provided with a pointing portion 23*a*, which is located in the scope of the indication window 25 and points at the values 25*a*. In operation, the user is able to directly observe the values 25*a* pointed by the pointing portion 23*a* on the housing 21, so as to efficiently read the torque value of the wrench.

Such torque wrench 20 replaces the originally exposed pointer. However, the general shape of the torque wrench 20 remains in a T shape, causing a similar issue of being unfavorable to portability and storage.

Further, regarding each known prior art above, the wrench applies the pointer or pointing member to sway in a relatively narrow angle to point out the torque scale. However, due to the narrow angle of swaying, the scales allowed to be pointed out are limited, such that the user is prevented from efficiently identify the torque level.

SUMMARY OF THE INVENTION

For improving the issues above, a torque indication wrench is disclosed. With the general profile performed in a pen shape, the consumed space is reduced, thus meeting the convenience of portability and storage.

For achieving the aforementioned objectives, an embodiment of the present invention provides a torque indication wrench, comprising:

a main body including a wrenching portion and a support portion connected with the wrenching portion, the wrenching portion rotating around a rotation axis for driving an object to rotate, the main body defining a longitudinal line arranged in vertical to the rotation axis and passing through the rotation axis, the longitudinal line defining two halves of the torque indication wrench divided by the longitudinal line into a counterclockwise area and an opposite clockwise area;

a torque rod including a first end and a second end, the first end connected with the support portion, the second end placed away from the rotation axis, a biasing section formed between the first and second ends, a central axis defined by the biasing section positioned in the counterclockwise area of the torque indication wrench; when the user wrenches the second end of the torque rod, the biasing section of the torque rod resiliently bends from the counterclockwise area of the torque indication wrench toward the clockwise area; and an indication device disposed between the main body and the torque rod; when the biasing section of the torque rod resiliently bends from the counterclockwise area toward the clockwise area, the user reads an indicated torque value displayed by the indication device.

Preferably, the central axis of the biasing section is disposed in the counterclockwise area, wherein the central axis of the biasing section does not overlap the longitudinal line of the main body and is arranged in parallel to the longitudinal line.

Preferably, the support portion is provided with a biased recess disposed in parallel to the longitudinal line. The central axis of the biased recess is placed in the counterclockwise area. The first end of the torque is received in the biased recess.

Preferably, the torque rod is formed in a straight shape.

Preferably, the support portion further comprises an enlarged groove connected with the biased recess, which allows the torque rod to resiliently bend from the counterclockwise area toward the clockwise area.

Preferably, the support portion and the wrenching portion are integrally formed. The support portion extends along the longitudinal line, wherein the extension length of the support portion is equal to or larger than the length of the wrenching portion positioned along the longitudinal line. The wrenching portion is allowed to be a unidirectional ratchet, a direction switchable ratchet, an opening end, a box end, or a sleeve. A positioning member is further included between the support portion and the torque rod.

Preferably, the main body further comprises a hollow case covering the support portion and extending along the longitudinal line. The second end of the torque rod projects from the case. The indication device is disposed on the case and connected with the biased section of the torque rod.

Preferably, a distal end of the case away from the wrenching portion is provided with a block member, wherein the block member includes a guide opening through where the second end of the torque rod passes to project.

Preferable, the second end of the torque rod is provided with a handle, wherein the center portion thereof is formed in a concave shape.

Preferably, the second end of the torque rod is provided with a handle, wherein the handle comprises two concave areas positioned in the counterclockwise area, and a resisted area positioned in the clockwise area and extending toward the main body.

Preferably, the indication device includes a toothed block disposed on the torque rod, and a rotary disc marked with a scale. The rotary disc is rotationally disposed on the case and provided with a gear which is engaged with the toothed block. The indication device further includes a mask mounted around the distal end of the case and the rotary disc, with an expose portion correspondingly exposing the scale on the rotary disc.

Preferably, length of a toothed side of the toothed block is larger than 2 times the radius of the gear.

Preferably, the rotary disc includes an inner disc and an outer disc, wherein the outer disc surrounds a periphery of the inner disc, and the outer disc is allowed to rotate against the inner disk.

With such configuration, besides the function for allowing the user to directly read the indicated torque value, with the torque rod biasedly disposed against the main body, the torque rod is wrenched from the counterclockwise area of the main body toward the clockwise area during the operation, thus ensuring that the torque indication wrench is generally maintained in a pen shape facilitating the space saving demand and advantageously meeting the convenience of storage and portability.

DETAILED DESCRIPTION OF THE INVENTION

Figure 1:
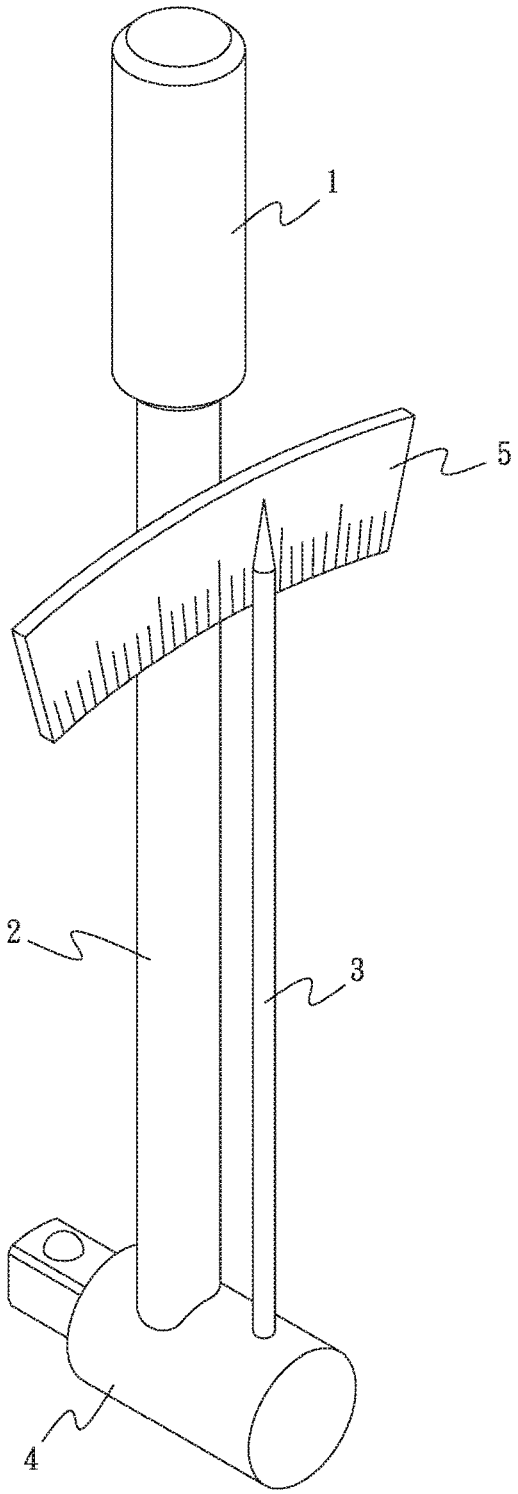
FIG. 1 is a perspective view of a known fine-tunable torque wrench structure.
Figure 2:
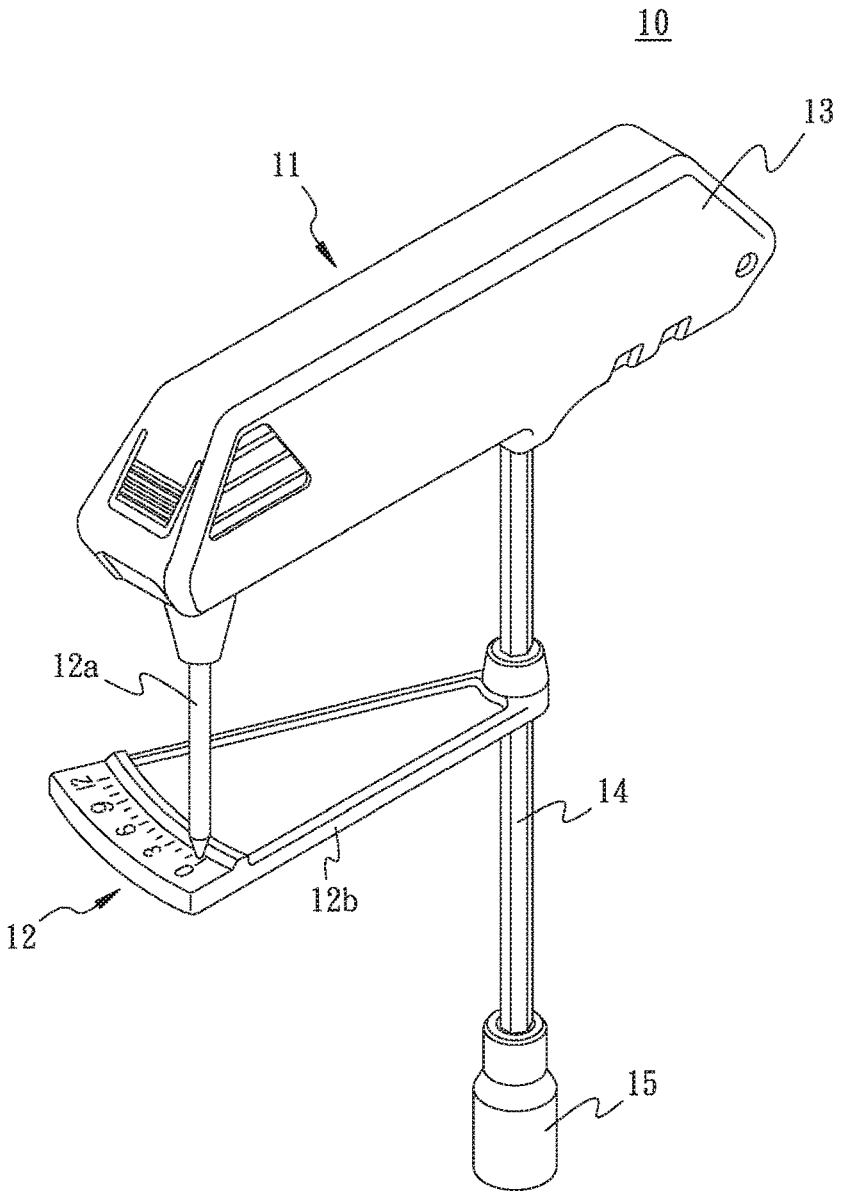
FIG. 2 is a perspective view of a known torque wrench.
Figure 3:
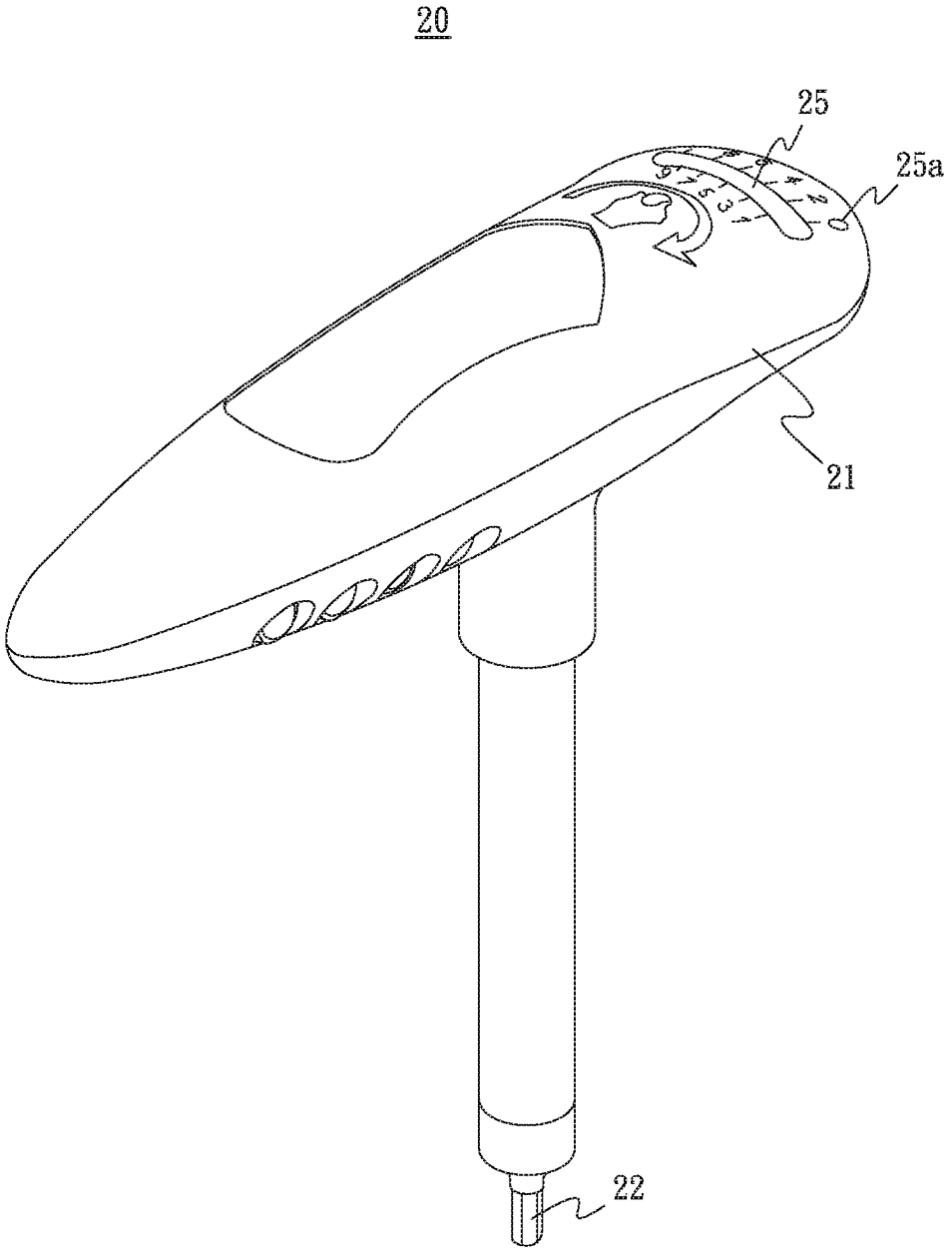
FIG. 3 is a perspective view of another known torque wrench.
Figure 4:
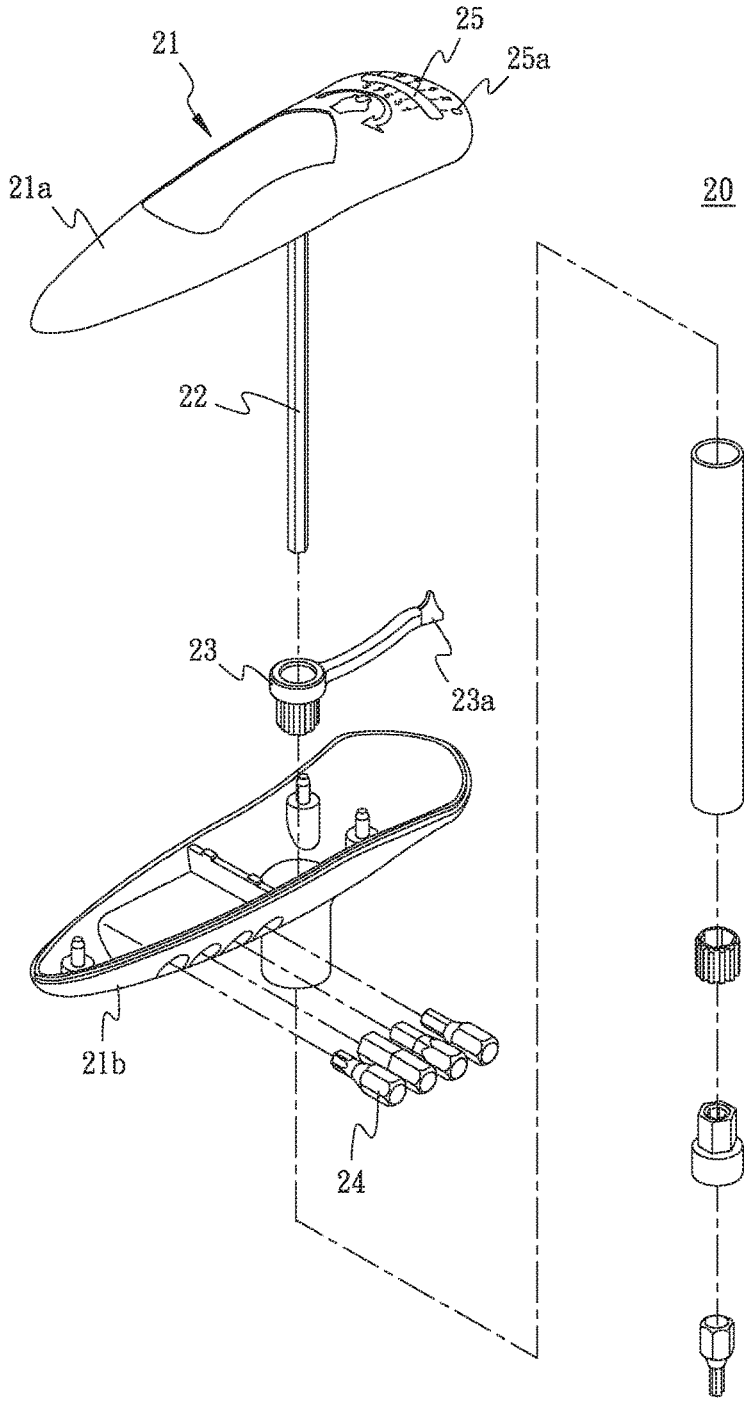
FIG. 4 is an exploded view of the torque wrench in FIG. 3.
Figure 5:
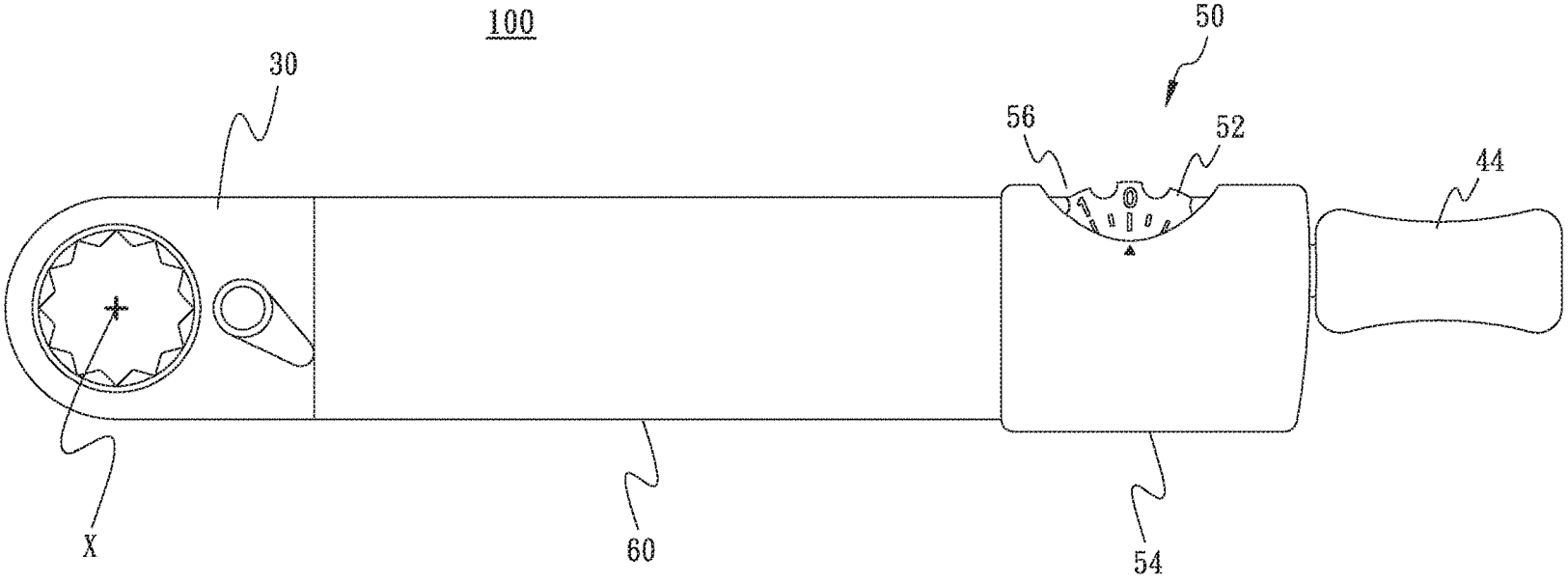
FIG. 5 is a top view of the torque indication wrench in accordance with an embodiment of the present invention.
Figure 6:
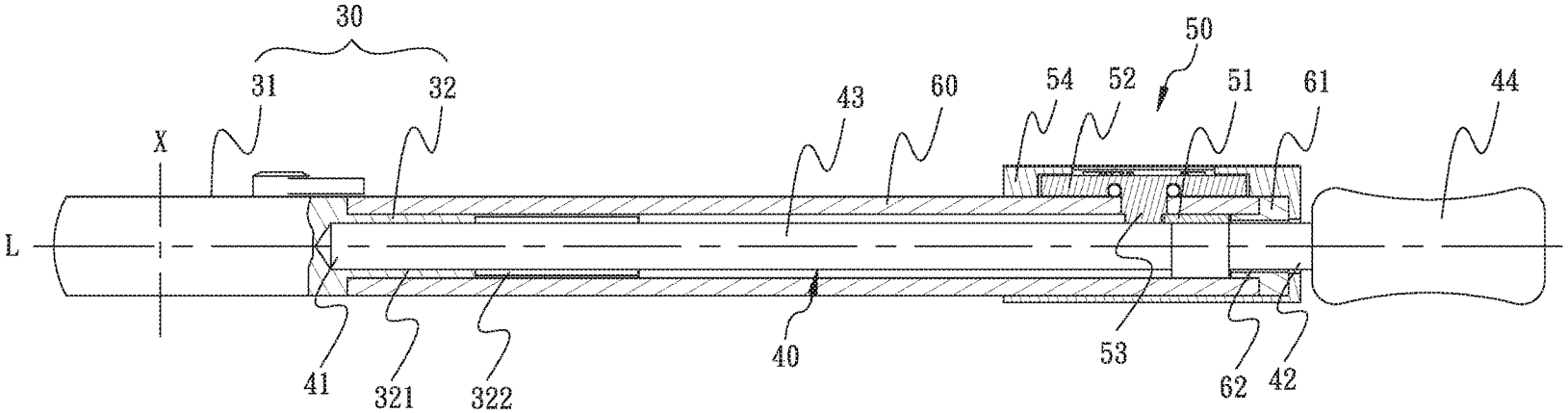
FIG. 6 is a laterally sectional view of the torque indication wrench in accordance with an embodiment of the present invention.
Figure 7:
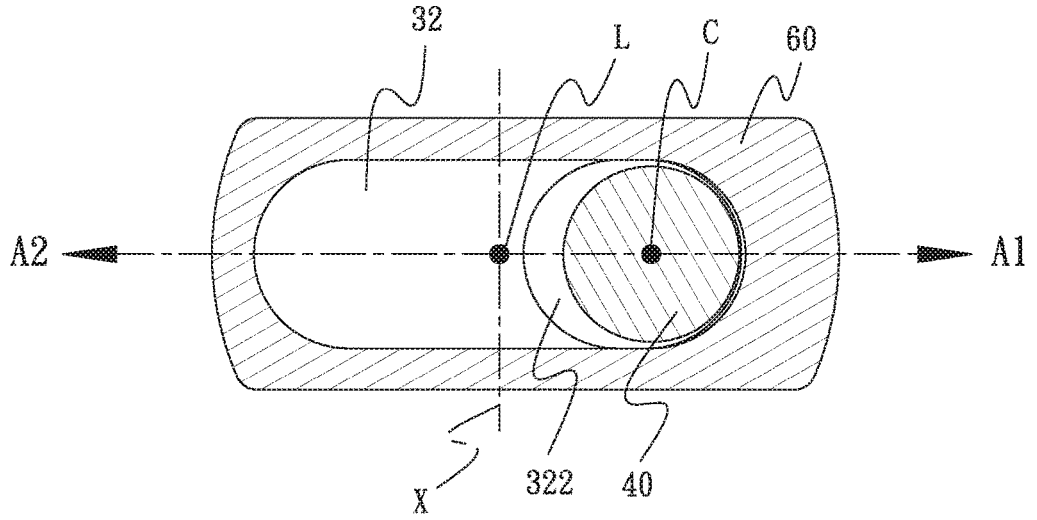
FIG. 7 is a vertically sectional view illustrating the relative positions of the torque rod and block member.

The aforementioned and further advantages and features of the present invention will be understood by reference to the description of the preferred embodiment in conjunction with the accompanying drawings where the components are illustrated based on a proportion for explanation but not subject to the actual component proportion. Embodiments of the present invention are illustrated in detail along with the drawings. However, the technical features included by the present invention are not limited to certain embodiments hereby provided. Scope of the present invention shall be referred to the claims, which include all the possible replacements, modifications, and equivalent features.

Referring to FIG. 5 to FIG. 11, the torque indication wrench 100 comprises a main body 30, a torque rod 40, and an indication device 50.

The main body 30 comprises a wrenching portion 31 and a support portion 32 connected with the wrenching portion 31. The wrenching portion 31 is allowed to be formed in a unidirectional ratchet, a direction switchable ratchet, an opening end, a box end, or a sleeve. Also, the wrenching portion 31 is able to rotate around a rotation axis X for driving an object to rotate. The main body 30 defines a longitudinal line L arranged in vertical to the rotation axis X and passing through the rotation axis X. The longitudinal line L further defines the two halves of the torque indication wrench 100 divided by the longitudinal line L into a counterclockwise area A1 and an opposite clockwise area A2. The counterclockwise area A1 is the area rotationally defined by the longitudinal line L when the user drives the wrench toward a counterclockwise direction; the clockwise area A2 is the area rotationally defined by the longitudinal line L when the user drives the wrench toward a clockwise direction.

In an embodiment of the present invention, the support portion 32 and the main body 30 are integrally formed. The support portion 32 extends along the longitudinal line L, and the extension length of the support portion 32 is equal to or larger than the length of the wrenching portion 31 positioned along the longitudinal line L. Also, the wrenching portion 31 of the main body 30 further comprises a first side 31*a* and a second side 31*b* disposed in opposite to the first side 31*a*, wherein the first side 31*a* and the second side 31*b* are disposed on two lateral sides of the longitudinal line L. In an embodiment of the present invention, the first side 31*a* is positioned in the counterclockwise area A1, and the second side 31*b* is positioned in the clockwise area A2. The support portion 32 is provided with a biased recess 321 disposed in parallel to the longitudinal line L, while the central axis of the biased recess 321 is positioned in the counterclockwise area A1. The support portion 32 further comprises an enlarged groove 322 connected with the biased recess 321, wherein the enlarged groove 322 is disposed on one side of the biased recess 321 away from the wrenching portion 31.

The torque rod 40 is formed in a straight shape and provided with a first end 41 and a second end 42, and the first end 41 of the torque rod 40 is connected with the support portion 32. In an embodiment of the present invention, the first end 41 of the torque rod 40 is received in the biased recess 321 of the support portion 32, and the enlarged groove 322 allows the torque rod 40 to resiliently bend from the counterclockwise area A1 toward the clockwise area A2. The second end 42 is disposed on one end of the torque rod 40 away from the rotation axis X of the wrenching portion 31. A biasing section 43 is formed between the first end 41 and the second end 42 of the torque rod 40. The biasing section 43 defines a central axis C positioned in the counterclockwise area A1 of the torque indication wrench 100, wherein the central axis C of the biasing section 43 does not overlap the longitudinal line L of the main body 30 and is arranged in parallel to the longitudinal line L.

When the user wrenches the second end 42 of the torque rod 40, the biasing section 43 of the torque rod 40 resiliently bends from the counterclockwise area A1 toward the clockwise area A2. In a non-operation status, the torque rod 40 is positioned in the range between the first side 31*a* and the second side 31*b* of the wrenching portion 31. In other words, the torque rod 40 does not move surpass the first side 31*a* and the second side 31*b* of the wrenching portion 31. Therefore, the torque indication wrench 100 of the present invention is generally formed in a pen shape, thus saving the space consumption and facilitating the convenience of storage and portability.

The indication device 50 is disposed between the main body 30 and the torque rod 40, such that when the user wrenches the second end 42 of the torque rod 40, the biasing section 43 of the torque rod 40 resiliently bends from the counterclockwise area A1 toward the clockwise area A2 of the main body 30, whereby the user is able to read the indicated torque value.

The main body 30 further comprises a hollow case 60 extending along the longitudinal line L, with one end of the hollow case 60 covering the support portion 32. The indication device 50 is disposed on the case 60 and connected with the biasing section 43 of the torque rod 40 for providing a torque indication. Furthermore, a distal end of the case 60 away from the wrenching portion 31 is provided with a block member 61. The block member 61 comprises a guide opening 62, such that the second end 42 of the torque rod 40 passes through and projects from the guide opening 62. Further referring to FIG. 6 and FIG. 7, where FIG. 7 omits the indication device 50 and displays the relative positions of the torque rod 40 and the block member 61, when the torque rod 40 is wrenched in clockwise, the guide opening 62 provides a movable space for the torque rod 40; when the torque rod 40 is wrenched in counterclockwise, the torque rod 40 is efficiently blocked.

In an embodiment of the present invention, the indication device 50 includes a toothed block 51, a rotary disc 52, a gear 53, and a mask 54. The toothed block 51 is disposed on the torque rod 40 and adjacent to the second end 42, with a toothed side arranged in an arc shape and facing the support portion 32. The rotary disc 52 is rotationally disposed on the case 60 and provided with scales displaying the torque value. The gear 53 is disposed on a bottom face of the rotary disc 52 and extends into the case 60 for being engaged with the toothed block 51, wherein a length of the toothed side of the toothed block 51 is larger than 2 times the radius of the gear 53. The mask 54 is mounted around the distal end of the case 60 and the rotary disc 52, with an expose portion 56 and an indicator correspondingly exposing and displaying the scales on the rotary disc 52. When the torque rod 40 is wrenched, the toothed block 51 drives the gear 53 to rotate, such that the rotary disc 52 rotates against the case 60, whereby the torque value imposed through the wrenching portion 31 upon an object is displayed at a corresponding scale. Also, the user is able to read the indicated scales through the expose portion 56.

Figure 8:
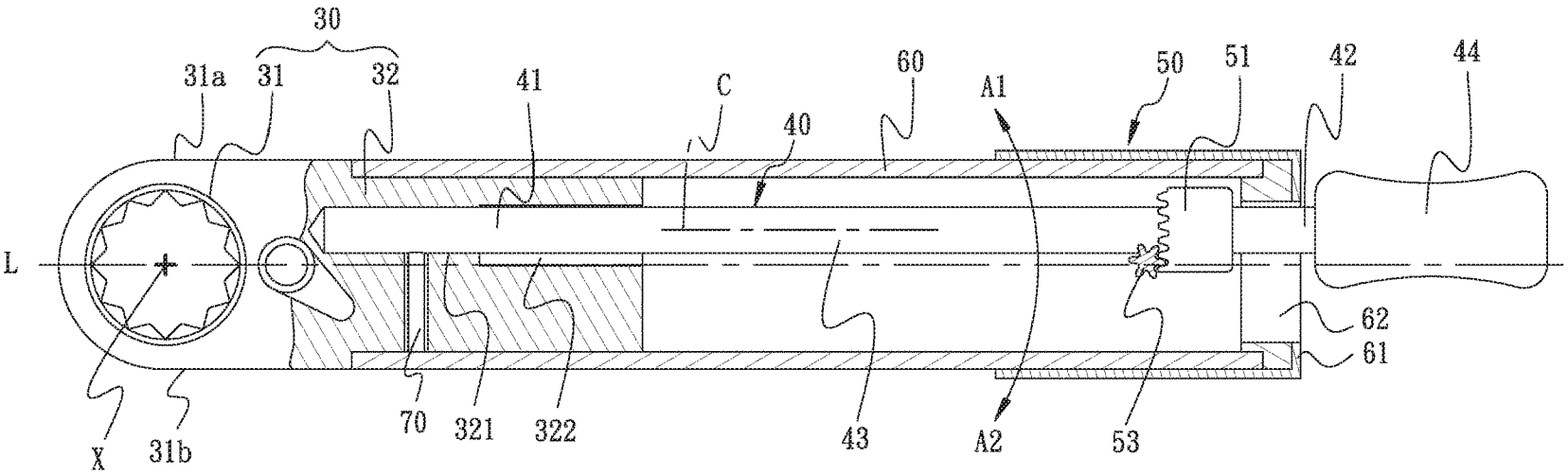
FIG. 8 is a transversely sectional view illustrating the torque rod in a non-operation status.

Referring to FIG. 8, a positioning member 70 is further included and disposed between the support portion 32 and the torque rod 40. Also, the positioning member 70 is allowed to be a screw member or a pin passing through the case 60 and the support portion 32 for resisting against the first end 41 of the torque rod 40, such that the torque rod 40 is stabilized and prevented from displacing.

In addition, the second end 42 of the torque rod 40 is further provided with a handle 44, wherein the central portion of the handle 44 is in a concave shape, such that the user is able to impose a concentrated force which is subsequently sent to the wrenching portion 31. As a result, the torque value is accurately indicated by the indication device 50.

Figure 9:
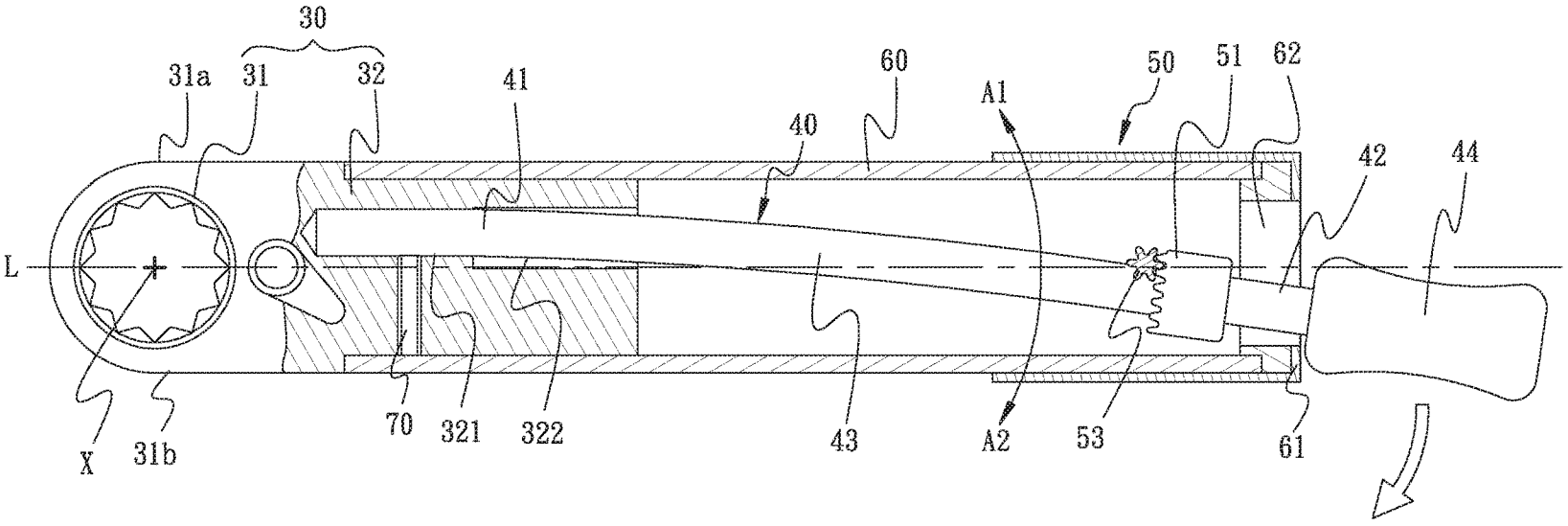
FIG. 9 is a transversely sectional view illustrating the torque rod being wrenched in an operation status.

Referring to FIG. 9 schematically illustrating the operation status of an embodiment of the present invention, the wrenching portion 31 is applied onto an object such as a screw member, and the user imposes a force through the second end 42 of the torque rod 40 and wrenches the torque rod 40 with the rotation axis X as the rotation center, whereby the biasing section 43 of the torque rod 40 resiliently bends from the counterclockwise area A1 of the main body 30 toward the clockwise area A2, so as to send the imposed force to the object and drive the object to rotate. If the imposed force is strengthened during the operation, the second end 42 of the torque rod 40 moves across the longitudinal line L. Upon the torque rod 40 resiliently bending, the toothed block 51 triggers the gear 53 to rotate, and subsequently drives the rotary disc 52 of the indication device 50 to correspondingly rotate. Therefore, the user is able to read the torque value imposed upon the object from the expose portion 56 of the mask 54, thereby controlling the fastening torque imposed upon the object.

In the embodiment, due to the length of the toothed side of the toothed block 51 larger than 2 times the radius of the gear 53, the intervals between the scale marks are amplified, thus favorable for the user to read. For example, when the torque rod 40 is wrenched by 10 degrees against the longitudinal line L, the gear 53 is allowed to rotate for three fourths round (270 degrees), so as to amplify the torque scale by 27 times. Therefore, the scales on the rotary disc 52 is divided into smaller sub-scales for displaying the torque value with greater accuracy, which is favorable for the user to read the current torque value.

Figure 10:
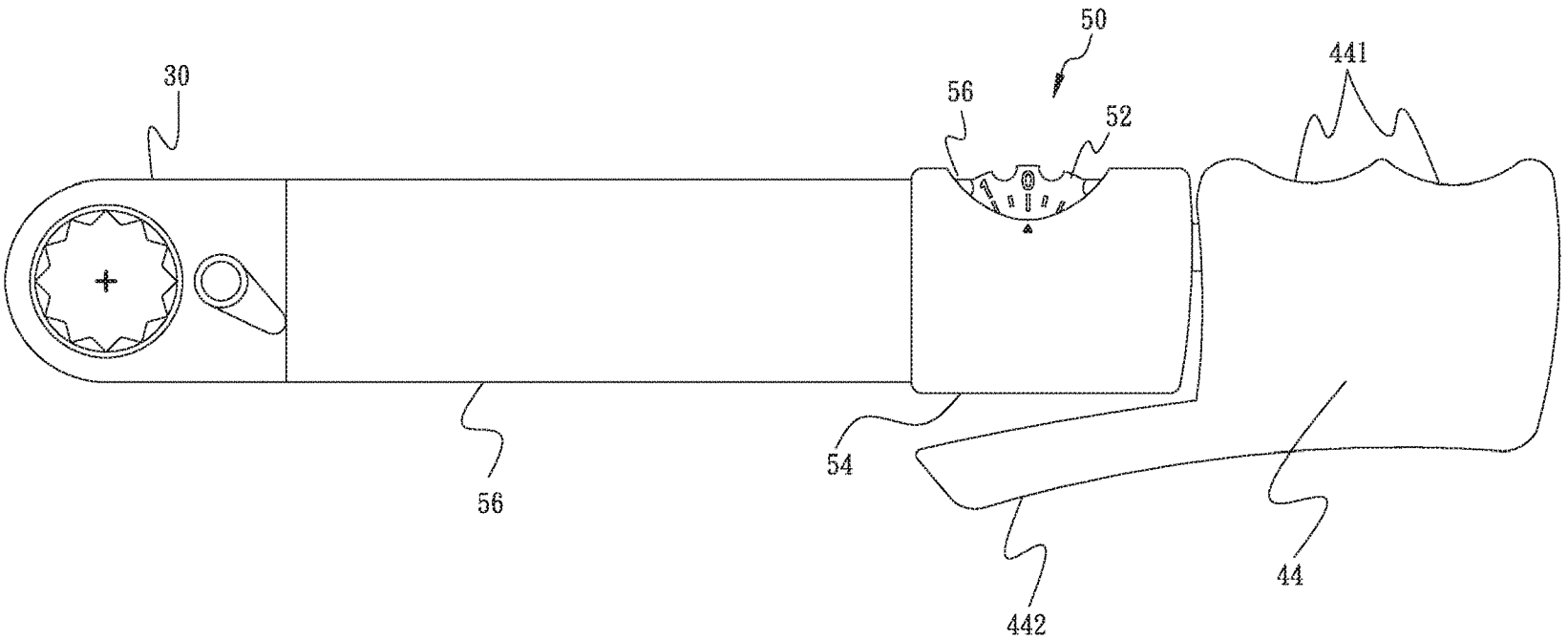
FIG. 10 is a top view of the torque wrench in accordance with another embodiment of the present invention.
Figure 11:
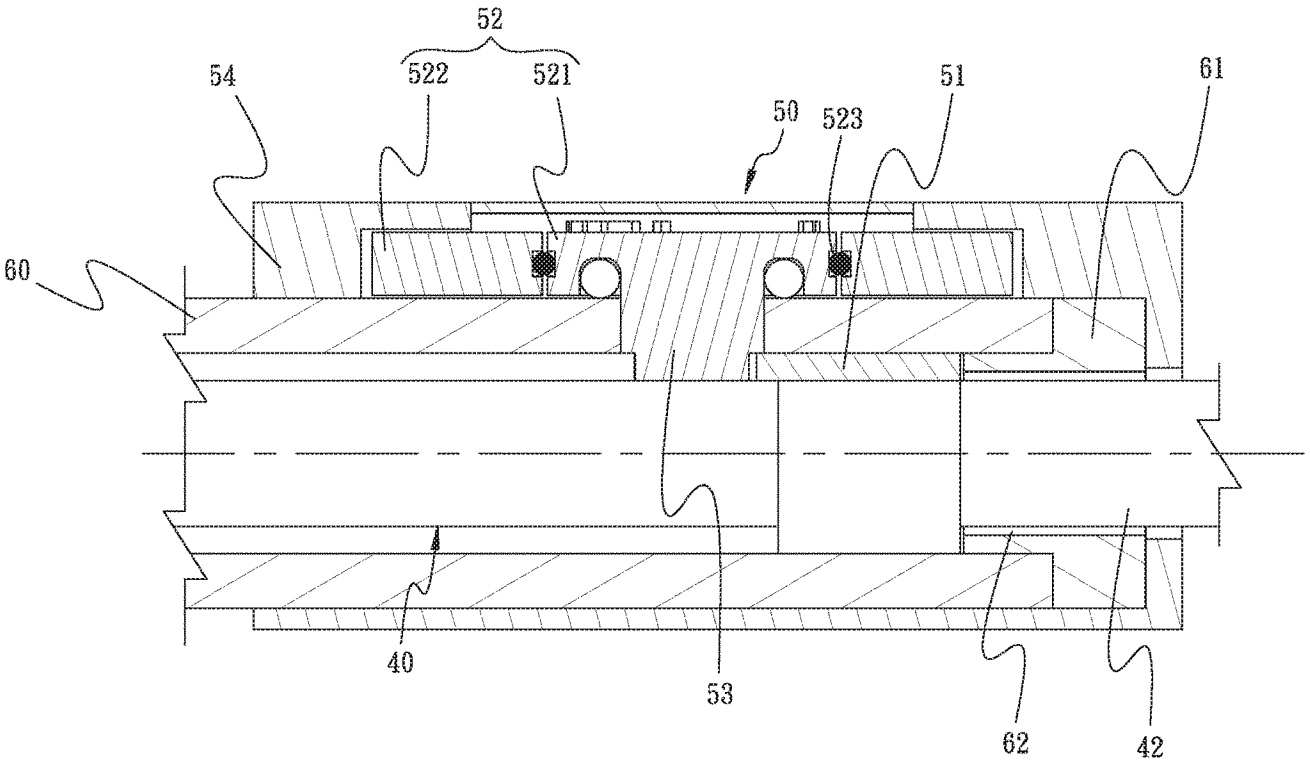
FIG. 11 is a partially enlarged view of FIG. 9.

Referring to FIG. 10 and FIG. 11 illustrating another embodiment of the present invention, the components in FIG. 10 similar or identical to the components in previous drawings are marked with identical numeric, and the detail descriptions of such components are hereby omitted. The difference of the present embodiment lies in that the handle 44 is provided with an ergonomic shape, wherein two concave areas 441 are disposed on one side of the handle 44 which is identical to the side of the indication device 50 provided with the expose portion 56. The concave areas 441 are positioned in the counterclockwise area A1 for bearing the middle finger and the forefinger of the user. Further, the other side of the handle 44 in opposite to the expose portion 56 is further provided with a resisted area 442 which extends toward the main body 30 for bearing the thumb of the user. During the wrenching operation, the resisted area 442 prevents a counter force generated by the user touching and imposing force upon the mask 54 of the indication device 50 and subsequently affect the accuracy of the torque value indicated by the indication device 50.

Referring to FIG. 10, the rotary disc 52 of the indication device 50 includes an inner disc 521, an outer disc 522, and a resistance member 523 between the inner disc 521 and the outer disc 522. The resistance member 523 is allowed to be an O-ring or a C-clamp. During the wrenching operation, through the resistance provided by the resistance member 523, the outer disc 522 and the inner disc 521 rotates together along the rotation of the gear 53. When a calibration is needed, the user rotates the outer disc 522 against the inner disc 521, such that the scale on the outer disc 522 is adjusted to return to zero against the indicator on the mask 54.

To sum up, the present invention allows the user to read the indicated torque value directly. Also, by the torque rod 40 disposed in bias against the main body 30, the torque rod 40 is wrenched from the counterclockwise area A1 of the main body 30 toward the clockwise area A2 during operation. Therefore, the general shape of the torque indication wrench 100 remains in a pen shape, thus saving the space consumption and facilitating the convenience of storage and portability.

Furthermore, due to the small sized of the torque indication wrench 100, the outward-projecting structure of the conventional torque wrenches is omitted. Therefore, accidental touching against the surrounding environment is prevented, thereby facilitating the convenience of usage.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A torque indication wrench, comprising:

a main body including a wrenching portion and a support portion connected with the wrenching portion, the wrenching portion rotating around a rotation axis for driving an object to rotate, the main body defining a longitudinal line arranged in vertical to the rotation axis and passing through the rotation axis, the longitudinal line defining two halves of the torque indication wrench divided by the longitudinal line into a counterclockwise area and an opposite clockwise area;

a torque rod including a first end and a second end, the first end connected with the support portion, the second end placed away from the rotation axis of the wrenching portion, a biasing section formed between the first and second ends, a central axis defined by the biasing section positioned in the counterclockwise area of the torque indication wrench; when the user wrenches the second end of the torque rod, the biasing section of the torque rod resiliently bends from the counterclockwise area toward the clockwise area; and an indication device disposed between the main body and the torque rod; when the biasing section of the torque rod resiliently bends from the counterclockwise area toward the clockwise area, the user reads an indicated torque value displayed by the indication device.

2. The torque indication wrench of claim 1, wherein the central axis of the biasing section is positioned in the counterclockwise area; the central axis of the biasing section does not overlap the longitudinal line of the main body and is arranged in parallel to the longitudinal line.

3. The torque indication wrench of claim 2, wherein the support portion is provided with a biased recess disposed in parallel to the longitudinal line; a central axis of the biased recess is positioned in the counterclockwise area; the first end of the torque is received in the biased recess.

4. The torque indication wrench of claim 3, wherein the torque rod is formed in a straight shape.

5. The torque indication wrench of claim 3, wherein the support portion further comprises an enlarged groove connected with the biased recess, allowing the torque rod to resiliently bend from the counterclockwise area toward the clockwise area.

6. The torque indication wrench of claim 5, wherein the support portion and the wrenching portion are integrally formed; the support portion extends along the longitudinal line; an extension length of the support portion is equal to or larger than a length of the wrenching portion positioned along the longitudinal line; the wrenching portion is selected from a group consisting of a unidirectional ratchet, a direction switchable ratchet, an opening end, a box end, and a sleeve; a positioning member is disposed between the support portion and the torque rod.

7. The torque indication wrench of claim 1, wherein the main body further comprises a hollow case extending along the longitudinal line, with one end of the hollow case covering the support portion; the second end of the torque rod projects from the case; the indication device is disposed on the case and connected with the biasing section of the torque rod.

8. The torque indication wrench of claim 7, wherein a distal end of the case away from the wrenching portion is provided with a block member; the block member comprises a guide opening through where the second end of the torque rod passes to project.

9. The torque indication wrench of claim 8, wherein the second end of the torque rod is provided with a handle; a central portion of the handle is formed in a concave shape.

10. The torque indication wrench of claim 8, wherein the second end of the torque rod is provided with a handle; the handle is provided with two concave areas positioned in the counterclockwise area, and a resisted area positioned in the clockwise area and facing the main body.

11. The torque indication wrench of claim 7, wherein the indication device comprises a toothed block disposed on the torque rod, and a rotary disc provided with scales rotationally disposed on the case, the rotary disc provided with a gear engaged with the toothed block.

12. The torque indication wrench of claim 11, wherein the indication device further comprises a mask mounted around a distal end of the case and the rotary disc, the mask provided with an expose portion correspondingly exposing the scales on the rotary disc.

13. The torque indication wrench of claim 11, wherein a length of a toothed side of the toothed block is larger than 2 times a radius of the gear.

14. The torque indication wrench of claim 11, wherein the rotary disc includes an inner disc and an outer disc, the outer disc surrounds a periphery of the inner disc and rotates against the inner disk.

15. The torque indication wrench of claim 14, wherein a resistance member is disposed between the inner disc and the outer disc.

16. The torque indication wrench of claim 15, wherein the resistance member is selected from a group consisting of an O-ring and a C-clamp.

* * * * *